US007036271B2

(12) United States Patent
Hjorth

(10) Patent No.: US 7,036,271 B2
(45) Date of Patent: May 2, 2006

(54) VASE AND FOOT THEREFOR

(76) Inventor: Birgit Hjorth, Torvegade 4, Nexø (DK) DK-3730

( * ) Notice: Subject to any disclaimer, the term of this patent is extended or adjusted under 35 U.S.C. 154(b) by 0 days.

(21) Appl. No.: 11/035,937

(22) Filed: Jan. 13, 2005

(65) Prior Publication Data

US 2005/0144841 A1 Jul. 7, 2005

Related U.S. Application Data

(63) Continuation of application No. PCT/DK03/000476, filed on Jul. 8, 2003.

(30) Foreign Application Priority Data

Jul. 16, 2002 (DK) ..... 2002 01110

(51) Int. Cl.
*A47G 7/02* (2006.01)

(52) U.S. Cl. ..... 47/41.01

(58) Field of Classification Search ..... None
See application file for complete search history.

(56) References Cited

U.S. PATENT DOCUMENTS

| | | | | | |
|---|---|---|---|---|---|
| 237,841 | A | * | 2/1881 | Erhard | 47/41.01 |
| 1,490,026 | A | * | 4/1924 | Richards | 47/41.01 |
| D242,160 | S | * | 11/1976 | Ruark | D11/155 |
| D300,521 | S | * | 4/1989 | Toltzman | D11/155 |
| 4,863,015 | A | | 9/1989 | Toltzman | 206/45.14 |
| 4,910,913 | A | | 3/1990 | Streeter | 47/72 |
| 5,060,798 | A | * | 10/1991 | Braastad | 206/423 |
| 5,657,868 | A | * | 8/1997 | Taylor | 206/423 |
| 6,672,002 | B1 | * | 1/2004 | Gumpper | 47/41.01 |
| 6,745,514 | B1 | * | 6/2004 | Myrland | 47/84 |

FOREIGN PATENT DOCUMENTS

| | | |
|---|---|---|
| EP | 0 240 628 | 10/1987 |
| EP | 0 394 595 A1 | 10/1990 |
| FR | 2 740 433 A1 | 4/1997 |
| WO | WO 99/67157 | 12/1999 |

* cited by examiner

*Primary Examiner*—Francis T. Palo
(74) *Attorney, Agent, or Firm*—Winston & Strawn LLP

(57) ABSTRACT

A vase made of a thin foldable material and having a wall, an upper opening and a lower bottom, provided with a foot, with the foot of the vase being formed by unfolding a first planar material along fold lines, with the first planar material designed with a central panel having essentially the same configuration as the bottom of the vase and defined by a first set of fold lines, a number of radial panels defined by a second set of fold lines and extending outwardly from the first fold lines, and a number of edge panels issuing from the second fold lines. The vase has a bottom formed by folding the bottom panels along the fold lines. The bottom is, by gluing, joined to a central panel of the first plane unfolding to secure the foot to the vase. The foot parts are provided by the radial panels and the edge panels folded up around the side panels or third fold lines of the vase. The vase is especially applicable as packaging during transport of a flower bouquet.

14 Claims, 9 Drawing Sheets

VASE AND FOOT THEREFOR

CROSS-REFERENCE TO RELATED APPLICATIONS

Figure 1:
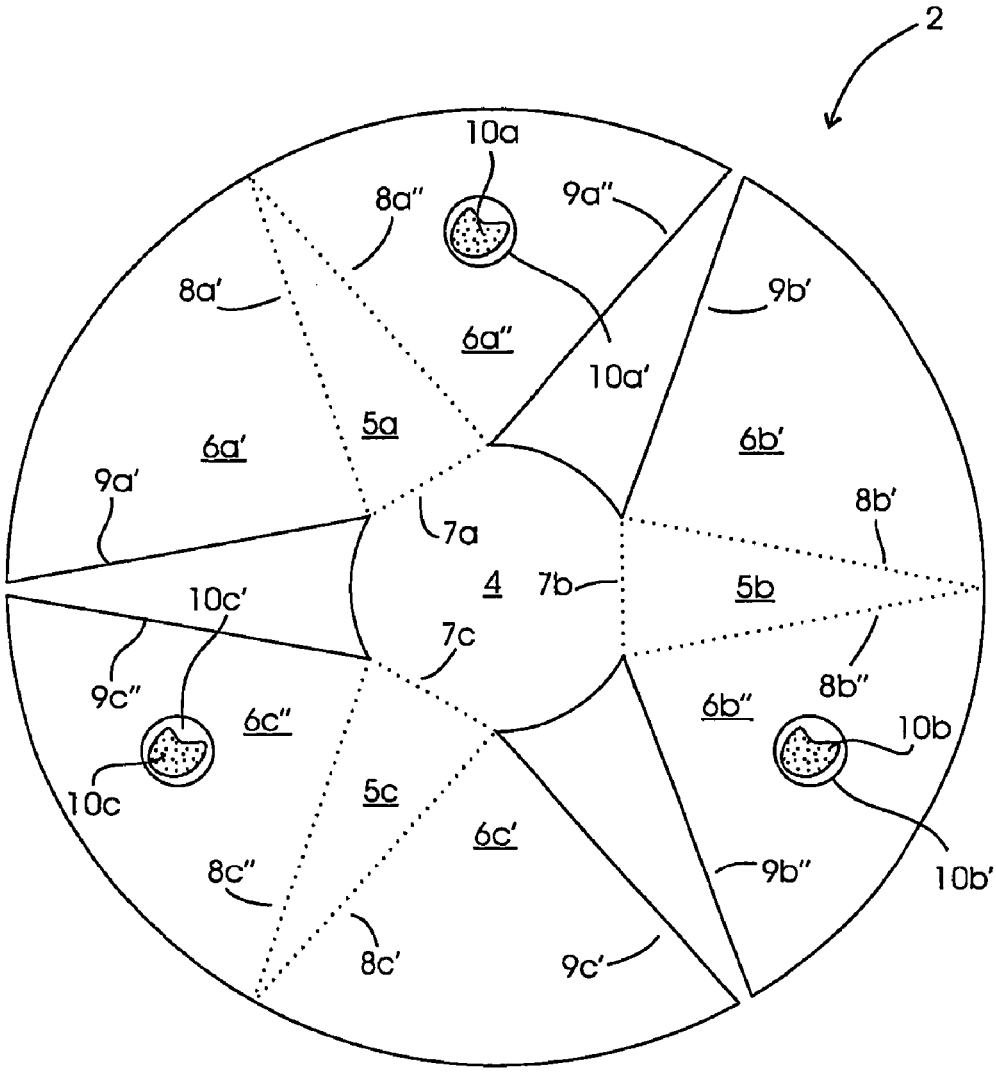

This application is a continuation of International application PCT/DK2003/000476 filed Jul. 8, 2003, the entire content of which is expressly incorporated herein by reference.

BACKGROUND

The invention relates to a vase of the kind that is made of a thin material, for example paper or cardboard, and that has a wall and an upper opening and a lower bottom—seen in the position of use as vase on e.g., a table.

When a flower bouquet is given as gift, it is not always possible to quickly procure a vase. The flowers can therefore not be put in water immediately, and the durability of the often expensive bouquet is reduced. This situation is known for example from a sick-visit in a hospital, where there often is a shortage of vases. Also at e.g. receptions where the number of flower bouquets can be very large, the possibility of putting the flowers in water is missing.

U.S. Pat. No. 4,910,913 patent discloses a folded cardboard vase with a triangular bottom and straight upwardly extending sides. This known vase is designed in such a way that it is difficult to hold when it is folded for holding flowers. The unassembled vase is arranged to be assembled only at the place of use, and the flower bouquet therefore must be transported separately. A vase arranged in such a way can only be assembled so that it is watertight with difficulty. This is due to the fact that the joints cannot be immediately sealed. Therefore it will be necessary to line the vase with a plastic bag to avoid the flower water from seeping out through the joints.

A similar vase that is also arranged to be assembled only at the place of use is known from the European patent application EP 0 394 595 A1. This known vase is made of a rigid material and lined internally with a watertight lining. The vase has a loose foot in form of a pyramidal mounting with a through opening surrounding a lower part of the body of the vase.

Besides the above-mentioned disadvantages, this known vase also has the disadvantage that the foot can easily slide off when the vase is lifted. The vase will furthermore stand unstably on a foundation if the relation between the height of the foot and the diameter of the opening in the top of the pyramid is not proportioned exactly to a corresponding height and diameter of the vase, which can be difficult when the vase is to be folded at the place of use. If the opening is too large, the vase will stand askew in the foot. If the opening is too small, there is a risk that the vase will overturn.

Thus, there is a need for a new vase that is inexpensive, environmentally friendly and easy to assemble, and this is now provided by the present invention.

SUMMARY OF THE INVENTION

The present invention satisfies the current needs by providing a vase of paper or cardboard that is easy and inexpensive to manufacture and is capable of being configured to be free-standing on a flat surface. Due to its construction, an environmentally sound vase that does not damage the environment is provided. The vase can be flattened after use and therefore takes up very little space in garbage disposal.

In addition, the vase can be made as a typical vase with a small bottom and large top opening, and is capable of standing securely and stably on e.g. a table. The vase is advantageously used as packaging for a bouquet. Furthermore, the vase can be decorated easily and inexpensively.

The novel and unique features of the invention includes the fact that the vase is provided with a foot formed by a first planar material that is folded along fold lines. Thereby an inexpensive vase can be manufactured in a simple manner, with the vase having a small bottom and large top opening, while still being able to stand securely and stably on a flat surface such as a table. Also, environmental benefits are provided by the invention as this vase is preferably made of paper or cardboard.

BRIEF DESCRIPTION OF THE DRAWING FIGURES

Figure 2:
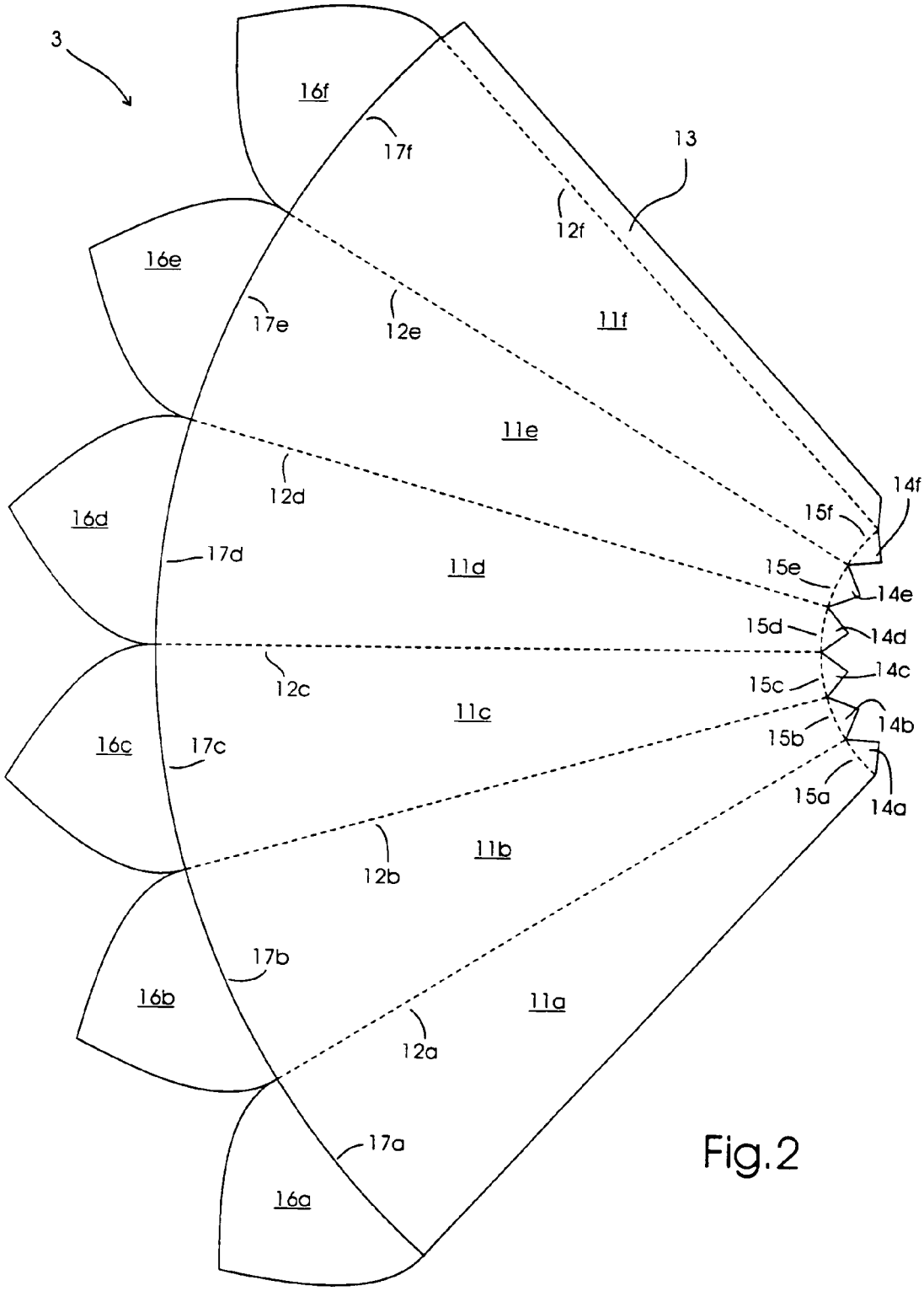
Figure 3:
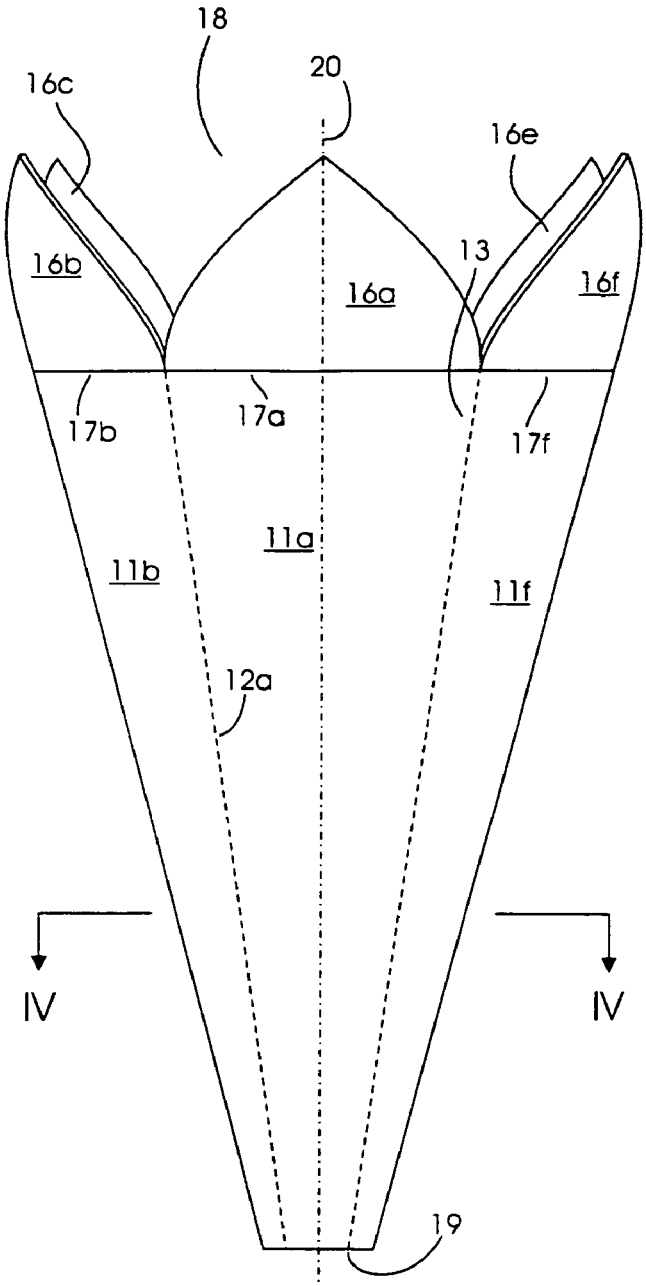
Figure 4:
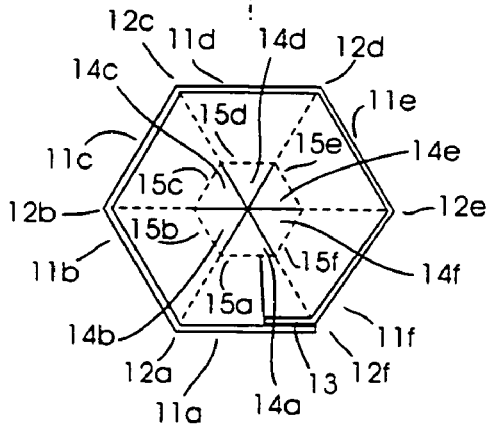
Figure 5:
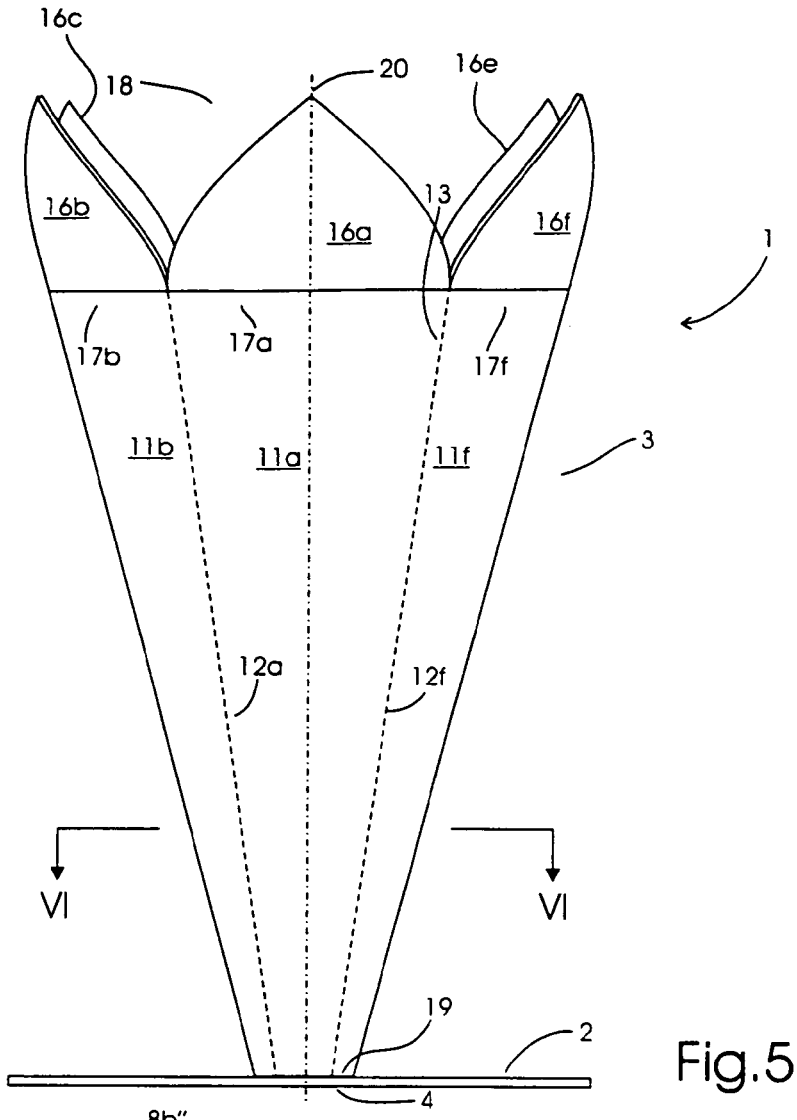
Figure 6:
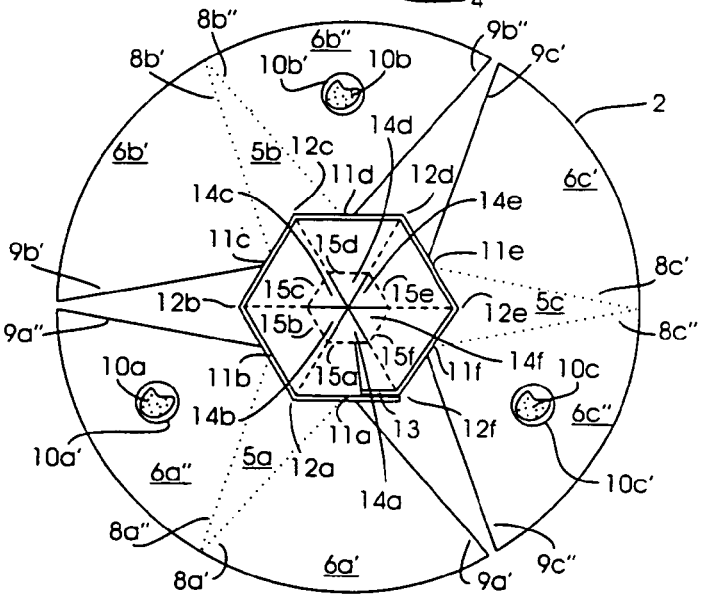
Figure 7:
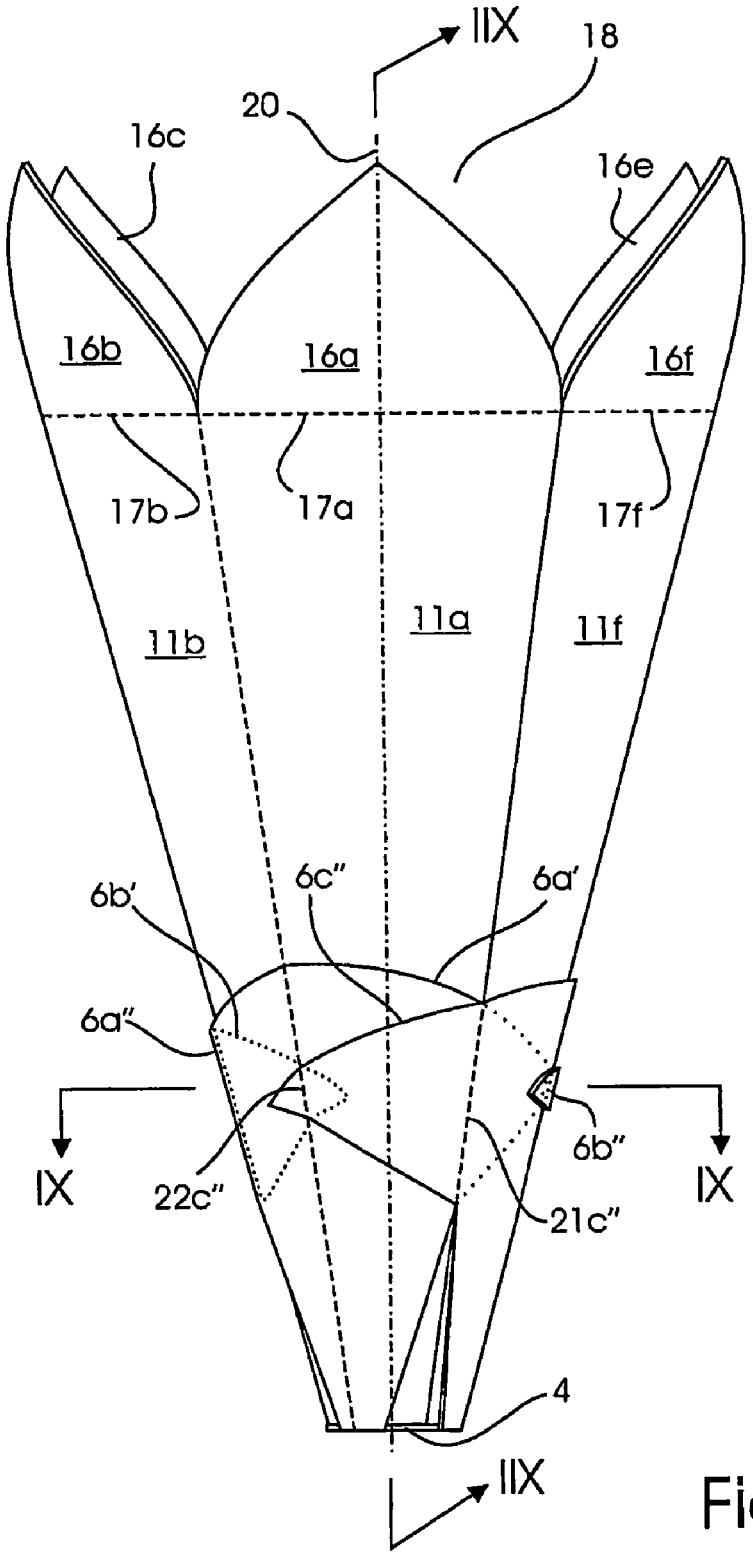
Figure 8:
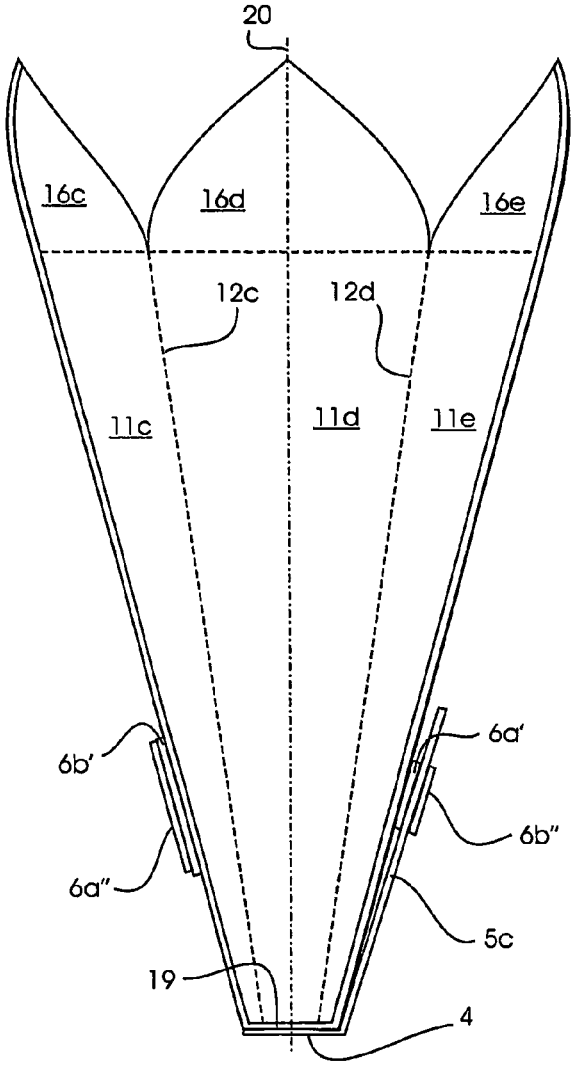
Figure 9:
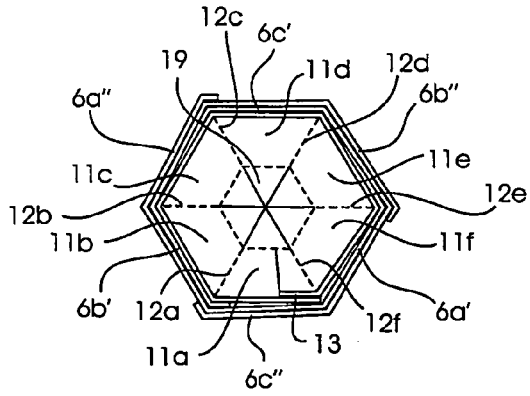
Figure 10:
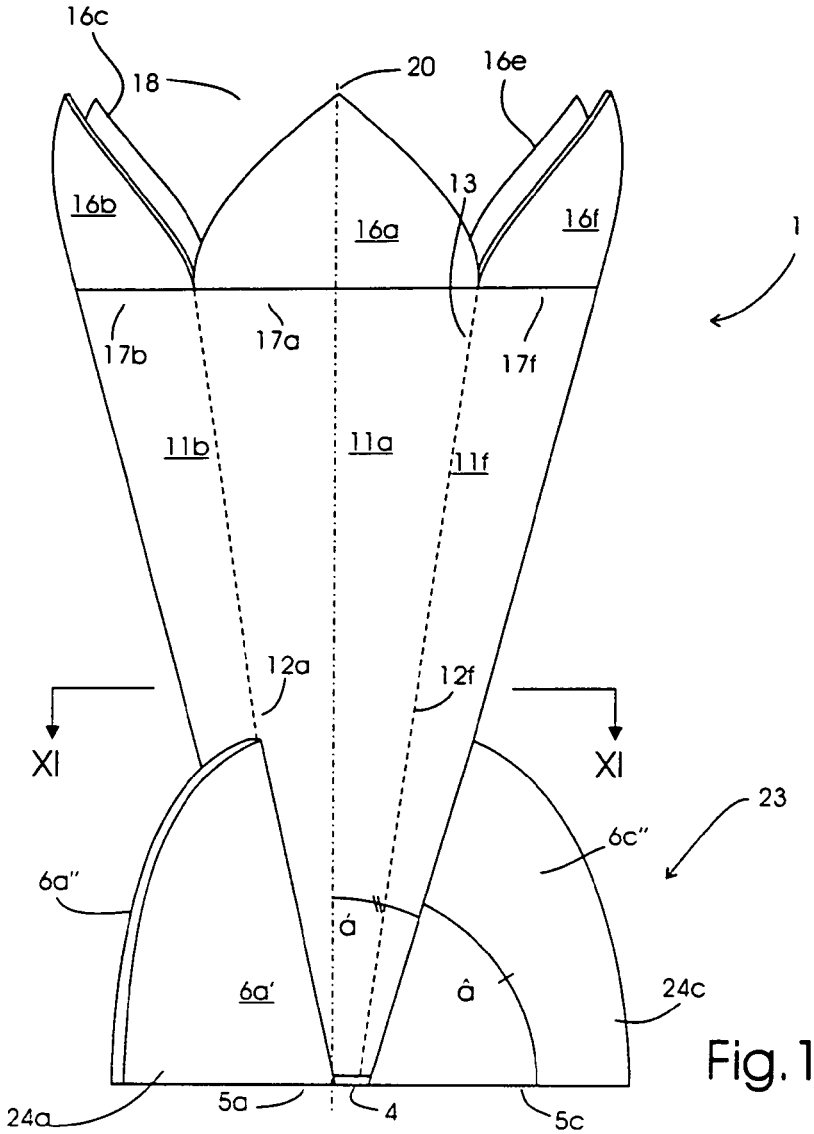
Figure 11:
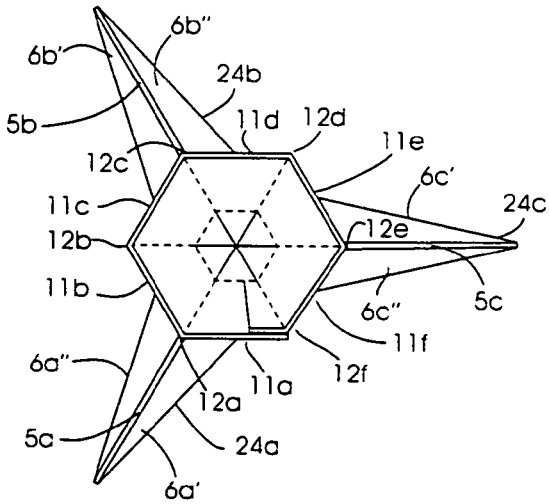
Figure 12:
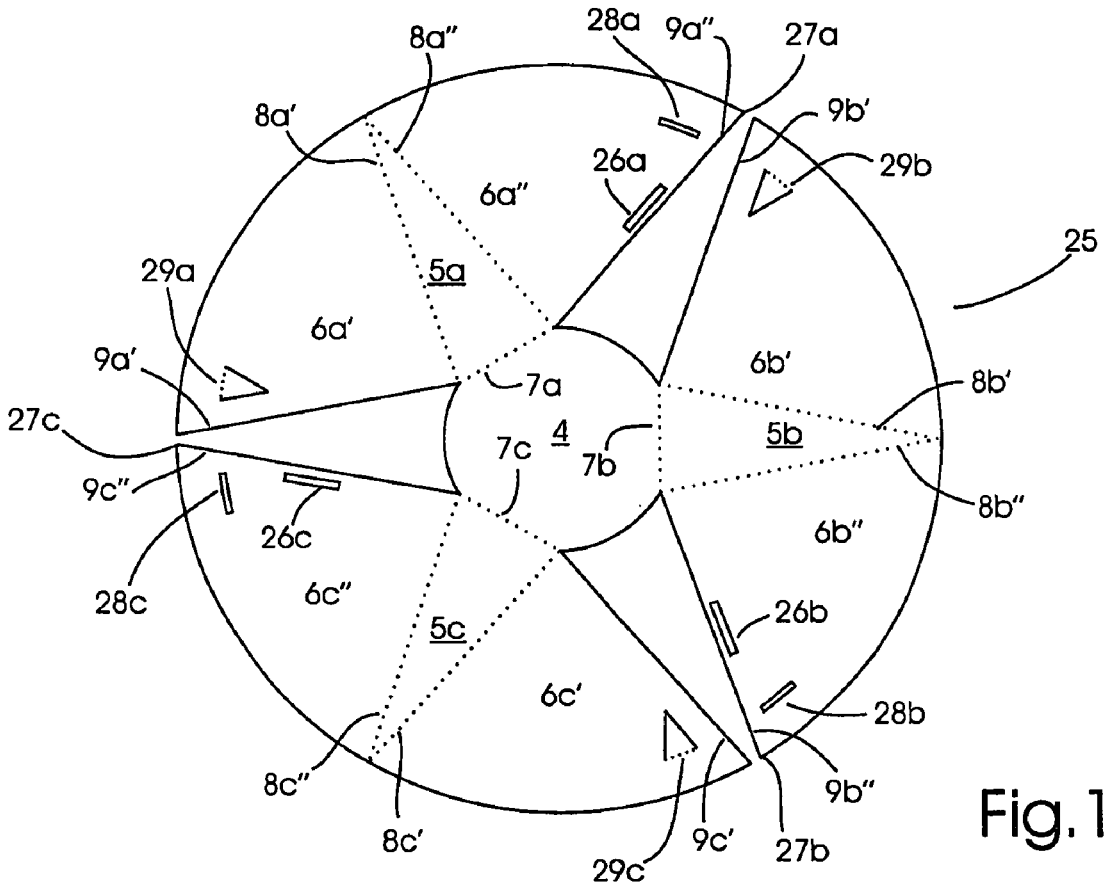
Figure 13:
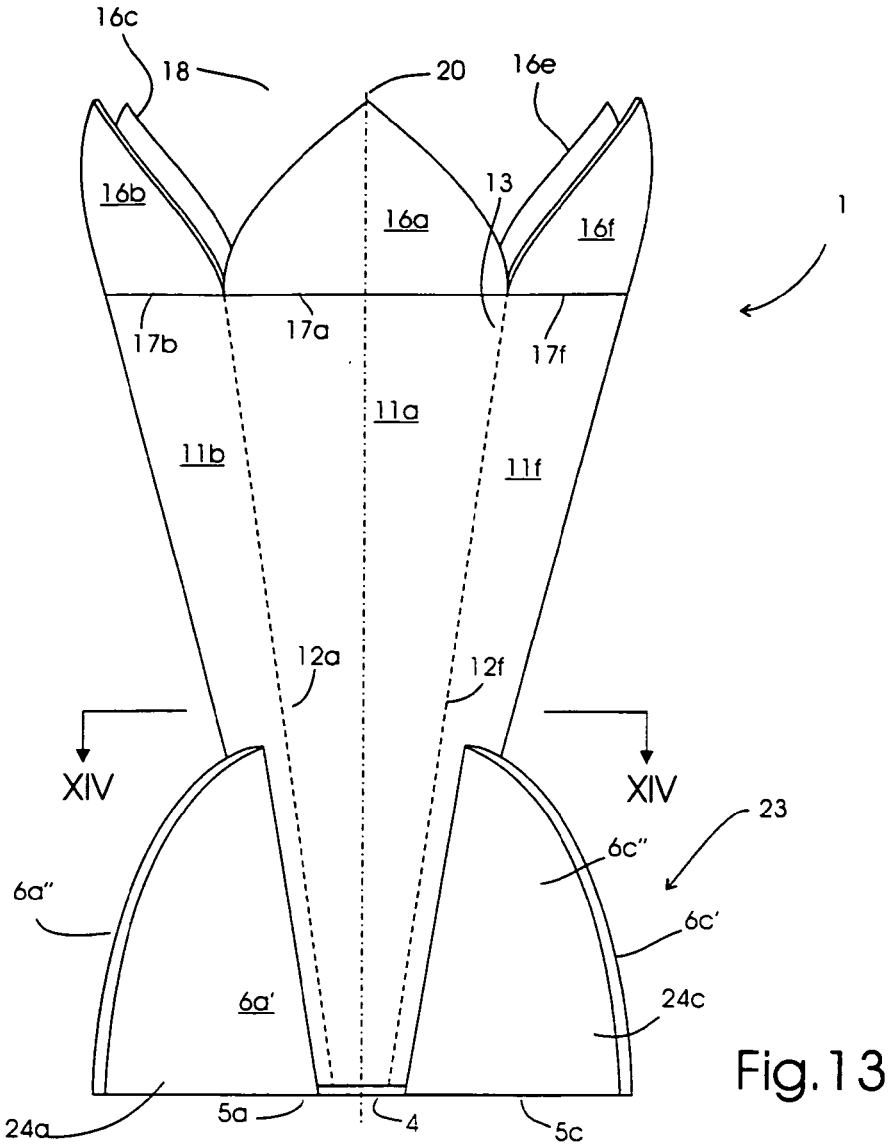
Figure 14:
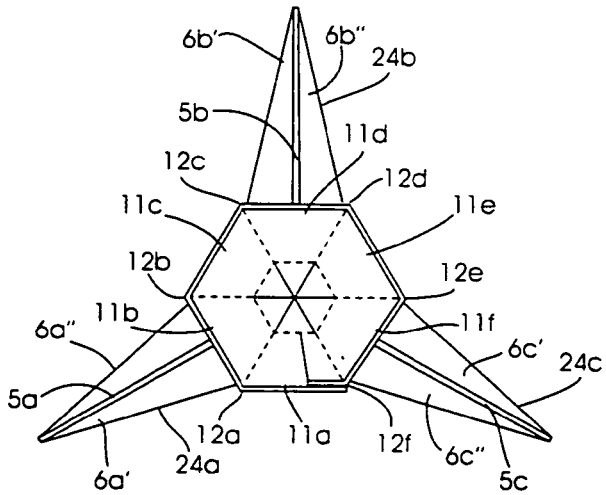

In the following, exemplary embodiments of the vase are described with reference to the drawings, in which:

FIG. 1 shows a planar material for a foot for a disposable vase according to the invention in a first embodiment, FIG. 2 shows a second planar material for the disposable vase according to the invention, FIG. 3 is a side elevational view of a wall of a disposable vase and formed by the second planar material in FIG. 2, FIG. 4 is a sectional view taken along the line IV—IV of FIG. 3, FIG. 5 is an axial sectional view of the wall of FIG. 3 for a disposable vase that is joined at the bottom to the first planar material as in FIG. 1, FIG. 6 is a sectional view taken along the line VI—VI of FIG. 5, FIG. 7 is a side elevational view of the disposable vase with the first planar material folded around the vase, FIG. 8 is a sectional view taken along the line IIX—IIX of FIG. 7, FIG. 9 is a sectional view taken along the line IX—IX of FIG. 7, FIG. 10 is a view of the vase of FIG. 9 with an unfolded, mounted foot, FIG. 11 is a sectional view taken along the line XI—XI of FIG. 10, FIG. 12 shows a second embodiment of the first planar material in FIG. 1, FIG. 13 shows a second embodiment of the vase according to the invention, and FIG. 14 is a sectional view taken along the line XIV—XIV of FIG. 13.

DETAILED DESCRIPTION OF THE PREFERRED EMBODIMENTS

In a preferred embodiment, the first planar material can be designed with a central panel, a number of radial panels and a number of edge panels. The central panel can advantageously be designed with the same configuration as the bottom of the vase and defined by a first set of fold lines. The central panel and vase bottom can therefore be joined in sealing connection especially easily by means of for example a water-insoluble adhesive at the first fold lines at the sides of the bottom. The radial panels can advantageously be defined by a second set of fold lines and be extending outwards from the first fold lines, whereas the edge panels advantageously can issue from the second fold lines.

In use as a vase on a flat surface such as a table, radial panels designed in such a way can be located on level with the central panel, whereas the edge panels easily can be folded up along the second fold lines. In this way, the radial panels can easily be made to serve as a base for a foot part, as the radial panels will be extending radially out from the vase in the position of use, whereas the upfolded edge panels will form flaps for additionally stiffening the foot parts against the vase.

Hereby the vase can, in a simple way, be made to assume the form of a vase with dimensional stability corresponding to a metal vase cast in one piece, a glass vase or a ceramic vase that all stand stably and securely on a table.

If the vase is used as packaging during transport of a flower bouquet, the radial panels and edge panels of the first second planar material can, at the first fold line, advantageously be folded up along at least a portion of the area of the vase wall that issues from the vase bottom. In this simple manner the vase with foot is given the shape of a handy cone, and a larger number of vases can easily be stacked and stored without occupying unnecessary space. If the foot is folded up around the vase, the foot furthermore is not a nuisance during transport of the vase with its content of a flower bouquet.

The walls of the vase can advantageously be formed by a second planar material designed with a number of side panels defined by a third set of fold lines, a number of bottom panels separated from the side panels by a fourth set of fold lines, a number of top panels separated from the side panels by a fifth set of fold lines, and a flap extending along at least one of the outermost fold lines in the third set. For example, the conic wall of the vase can expediently be formed by folding the second planar material along the third set of fold lines until the two outermost side panels meet. Finally, the vase is assembled by letting the flap overlap a side panel and then fastening the flap in a watertight manner by gluing along this side panel. The bottom panels can easily be folded along the fourth set of fold lines to form the bottom of the vase, whereas the top panels can be folded to a desired extent along the fifth set of fold lines to form a decorative upper end of the vase.

By bending the top panels towards the longitudinal central axis of the vase, these top panels can contribute to the holding of the flowers in the vase during transport and prevent a content of water from splashing out of the vase. Where the vase is placed with a flower decoration on a flat surface such as a table, the top panels can instead be bent a little outwards and thereby support a bouquet and decoratively follow its shape. The polygonal shape of the vase—seen in cross section—has the effect of the vase being resistant to being compressed in cross direction. Furthermore, the vase can easily be decorated with desired motifs as the decoration easily can be applied to the second planar material.

The first planar material can furthermore be designed in such a way that the edges of the edge panels issuing from the first fold lines are abutting against and supporting against the adjacent side panels of the vase in the position of use of the foot and the vase. Hereby, an advantageous, stable construction and support of the vase are obtained when this vase is filled with flowers and water. Where each side panel is designed as a trapezium with the smallest side along the fourth set of fold lines, a vase having a small bottom and a large opening can advantageously be formed. Vases having different dimensions can be obtained by changing the side lengths of the trapezium.

In a preferred, especially stable embodiment of a vase according to the present invention, the first planar material can be designed with a total of three radial panels and the second planar material with a total of six side panels. Both planars material can easily be stamped out of a sheet or a web of a desired material. Simultaneously or in a subsequent process the planar material can be given the desired fold lines by means of techniques known in the art.

Where the radial panels are folded up around the first fold lines and edge panels around the vase, respectively, the associate edge panels can furthermore be designed with sixth and seventh sets of fold lines extending along each their third fold lines of the second planar material. Alternatively these last-mentioned sixth and seventh fold lines arise by themselves when the radial panels and edge panels are forced to their upfolded, secured position around the lower area of the vase at its bottom.

Before use arranged as vase, the radial panels and edge panels of the foot will thus normally be folded around the vase where they conveniently can be kept fixed by means of e.g. a rubber band. In this state the vase with small bottom and large opening takes up very little space during transportation and storing, the vases being able to be inserted in each other as mentioned above. Instead of a rubber band the foot can be fixed in this state by a first slit being made in the edge panels at an angular distance of 120°, each slit receiving the point of a second edge panel when the radial panels including the edge panels are folded up at the first fold lines to surround the side panels of the vase. This solution is especially advantageous, as no further means are needed to secure the unmounted foot around the vase.

In the position of use when the foot is folded to be able to stand on a foundation, the edge panels on each foot part must be joined at least partially. By way of example the foot can be kept assembled supporting and abutting against the side walls of the vase by two edge panels associated to the radial panel and located on the first plane unfolding being joined by a staple or clip in the unfolded state of the radial panel and the upfolded state of the edge panels.

An alternative way of keeping the foot assembled in the desired form is to apply an adhesive on at least an area of the top surface of at least one of the two edge panels associated to a radial panel and located on the first plane unfolding. The adhesive can e.g. be of the kind that is protected by a pull-off film that is easily torn off when the foot is to be mounted for use as support to the vase.

In an advantageous embodiment for quickly and easily joining the edge flaps of two opposite edge panels, one of the two edge panels associated to a radial panel and located on the first planar material is designed with a second slit, and the second edge panel is designed with a partially cut-out flap for insertion in the second slit when the edge panels are folded up around the second fold lines. This embodiment is especially easy to assemble when the vase is to be assembled for use and correspondingly easy to disassemble when the vase is to be discarded. The preferred embodiment described above appears as an aesthetically beautiful, hexagonal vase with three foot parts that form a stable support for the vase when it is filled with water and flowers.

The vase according to the invention is described in more detail in the following, assuming by way of example that the vase is a disposable vase made of paper with a wax layer on the side that will form the inside of the vase so that the vase remains watertight even though it is made of paper.

FIGS. 1 and 2 show a first planar material 2 and a second planar material 3, respectively, serving as blanks to form a foot and a wall, respectively, that can be folded and assembled to a disposable vase 1 according to the invention.

The first planar material 2 has a circular central panel 4, three triangular radial panels 5*a*, 5*b*, 5*c*, and six edge panels 6*a*', 6*a*", 6*b*', 6*b*", 6*c*', 6*c*". The radial panels 5*a*, 5*b*, 5*c* are connected to respectively the central panel 4 via a first set of fold lines 7*a*, 7*b*, 7*c* and to the edge panels 6*a*', 6*a*", 6*b*', 6*b*", 6*c*', 6*c*" via a second set of fold lines 8*a*', 8*a*", 8*b*', 8*b*", 8*c*', 8*c*".

Thus, the edge panel 6*a*' is extending from the radial panel 5*a* via second fold line 8*a*' towards a free edge 9*a*', the edge panel 6*a*" is extending from the radial panel 5*a* via second fold line 8*a*" towards a free edge 9*a*", the edge panel 6*b*' is extending from the radial panel 5*b* via second fold line 8*b*' towards a free edge 9*b*', the edge panel 6*b*" is extending from the radial panel 5*b* via second fold line 8*b*" towards a free edge 9*b*", the edge panel 6*c*' is extending from the radial panel 5*c* via second fold line 8*c*' towards a free edge 9*c*', the edge panel 6*c*" is extending from the radial panel 5*c* via second fold line 8*c*" towards a free edge 9*c*', and the edge panel 6*c*" is extending from the radial panel 5*c* via second fold line 8*c*" towards a free edge 9*c*".

On each edge panel 6*a*", 6*b*", 6*c*", an adhesive 10*a*, 10*b*, 10*c* is applied that e.g. is protected by a piece of overlying pull-off film 10*a*', 10*b*', 10*c*' for preventing unintentional fastening of the edge panels.

The first plane unfolding 2 is typically stamped as a circular blank, the fold lines being indicated or embossed simultaneously on the blank.

FIG. 2 shows the second planar material 3 having, in the case shown, six trapezoidal side panels, a first side panel 11*a* connected, via a first third fold line 12*a*, to a second side panel 11*b* which in its turn is connected, via a second third fold line 12*b*, to a third side panel 11*c* which in its turn is connected, via a third fold line 12*c*, to a fourth side panel 11*d* which in its turn is connected, via a fourth third fold line 12*d*, to a fifth side panel 11*e* which in its turn is connected, via a fifth third fold line 12*e*, to a sixth side panel 11*f* which in its turn is connected, via a sixth third fold line 12*f*, to a flap 13 for, after folding along the set of third fold lines 12*a*, 12*b*, 12*c*, 12*d*, 12*e*, 12*f*, overlapping the first side panel 11*a* and being joined in a watertight way to this to form the wall 3 of the vase. The joining can expediently take place by means of adhesives known to a person skilled in the art.

The second planar material 3 furthermore has a total of six bottom panels 14*a*, 14*b*, 14*c*, 14*d*, 14*e*, 14*f* that, in the case shown, mainly are triangular. Bottom panels 14*a*, 14*b*, 14*c*, 14*d*, 14*e*, 14*f* are, via respective fourth fold lines 15*a*, 15*b*, 15*c*, 15*d*, 15*e*, 15*f*, connected to respective side panels 11*a*, 11*b*, 11*c*, 11*d*, 11*e*, 11*f*. Furthermore, the second planar material 3 has a total of six top panels 16*a*, 16*b*, 16*c*, 16*d*, 16*e*, 16*f* that, via a set of respective fifth fold lines 17*a*, 17*b*, 17*c*, 17*d*, 17*e*, 17*f*, are connected to respective side panels 11*a*, 11*b*, 11*c*, 11*d*, 11*e*, 11*f*.

FIG. 3 shows the conic wall 3 formed by the second planar material 3 for a disposable vase 1 according to the invention, in which the sixth side panel 11*f* of the second planar material 3 is joined to the flap 13 as described with reference to FIG. 2, to thus form a vase having an upper opening 18 and a lower bottom 19.

FIG. 4 is a sectional view taken along the line IV—IV of FIG. 3. The bottom panels 14*a*, 14*b*, 14*c*, 14*d*, 14*e*, 14*f* are folded perpendicularly inward towards the central axis 20 of the vase at the fourth folding lines 15*a*, 15*b*, 15*c*, 15*d*, 15*e*, 15*f* to at least partly close the bottom 19 of the vase.

FIGS. 5 and 6 show the second planar material 3 of FIGS. 3 and 4 folded to form the wall 3 and hollow body of the vase, the bottom 19 of which is located perpendicularly to and joined to the central panel 4 of the first planar material 2 in FIG. 1. The two planar material 2 and 3 are joined easily and permanently by means of an adhesive such as e.g. a waterproof glue.

As seen best in FIGS. 7, 8 and 9, the radial panels 5*a*, 5*b*, 5*c* can be folded via the fold lines 7*a*, 7*b*, 7*c* up around the wall 3 of the vase when the vase is to serve as packaging e.g. during transport of a flower bouquet. The radial panels 5*a*, 5*b*, 5*c* bring respective edge panels 6*a*', 6*a*", 6*b*', 6*b*", 6*c*', 6*c*", and both the radial panels and the edge panels encompass relatively closely the conic vase by overlapping each other. Thereby a sixth set of fold lines 21*a*', 21*a*", 21*b*', 21*b*", 21*c*', 21*c*" and a seventh set of fold lines 22*a*', 22*a*", 22*b*', 22*b*", 22*c*', 22*c*", respectively, are created on the edge panels 6*a*', 6*a*", 6*b*', 6*b*", 6*c*', 6*c*". In this state the vase can be held easily and elegantly in one hand to transport e.g. a flower bouquet (not shown). Alternatively the sixth and seventh fold lines can be pre-embossed in the edge panels so that these panels yield especially easily to the shape of the vase.

In the transport and/or storage situation, the radial and edge panels can advantageously be secured in towards the side panels of the vase by means of e. g. a (not shown) rubber band.

FIGS. 10 and 11 show the vase 1 in mounted state with the first planar material 2 folded to a foot 23 that, in the case shown, has a total of three foot parts 24*a*, 24*b*, 24*c*, of which only the foot parts 24*a* and 24*c* are visible in FIG. 10. The first planar material 2 is shown here adhesively mounted on the second planar material 3 with the radial panels 5*a*, 5*b*, 5*c* located opposite a fold line 11*b*, 11*d*, 11*f*. The radial panels 5*a*, 5*b*, 5*c* are furthermore located in the same plane as the central panel 4 and an adhesive is possibly prepared on at least three edge panels.

Two edge panels issuing from the same radial panels are folded along their second fold lines to form a foot part. The first foot part is for example formed by folding the edge panel 6*a*' along the fold line 8*a*' and the edge panel 6*a*" along the fold line 8*a*" in a direction towards each other and then gluing or in another way fixing, for example by means of staples, the two edge panels 6*a*' and 6*a*" solidly together in e.g. the area along their free edges 9*a*' and 9*a*". The two other foot parts are formed in a similar manner. When the radial panels and edge panels are folded to foot parts, the foot is ready-assembled and ready for use with a flower bouquet.

The vase can especially advantageously be designed so that the sum of an angle $\alpha$ between the central axis 20 of the body and either a side panel 11*a*, 11*b*, 11*c*, 11*d*, 11*e*, 11*f* or a third fold line 12*a*, 12*b*, 12*c*, 12*d*, 12*e*, 12*f* and an angle $\beta$ between the respective second fold lines 8*a*', 8*a*", 8*b*', 8*b*", 8*c*', 8*c*" and free edges 9*a*', 9*a*", 9*b*', 9*b*", 9*c*', 9*c*" of an edge panel is equal to or slightly greater than 90°. The foot parts on a vase formed and mounted in this vase will abut against the sides of the vase, the hollow body of the vase and the foot parts 24*a*, 24*b*, 24*c* being pressed towards each other in the position of use and thereby contributing to increasing the stability of the vase and maintaining its shape.

FIG. 12 shows an alternative embodiment 25 of the first planar material. This embodiment is a modification of the first planar material 2 according to the invention and like parts are similarly referenced. On each edge panel 6*a*", 6*b*", 6*c*", first slits 26*a*, 26*b*, 26*c* for receiving the free point 27*a*, 27*b*, 27*c* of an edge panel are provided at a mutual angular distance of 120° and along the free edge 9*a*", 9*b*", 9*c*" of the respective edge panel. When the vase is folded for transport or packaging, the free corner 27*a* of the edge panel 6*a*" engages the slit 26*b* on the edge panel 6*b*", the free corner of which engages the slit 26*c* on the edge panel 6*c*", the free corner of which engages the slit 26*a* on the edge panel 6*a*", and the edge panels can, in this simple way, easily be maintained around the vase without use of e.g. a rubber band.

On each edge panel 6*a*", 6*b*", 6*c*", second slits 28*a*, 28*b*, 28*c* for engaging partially cut-out flaps 29*a*, 29*b*, 29*c* on the edge panels 6*a*', 6*b*', 6*c*' are furthermore provided at mutual angular distance of 120° and along the periphery of first planar material 25. Two opposite edge panels folded around their adjacent radial panel in direction towards the vase can, in this simple way, be secured just as the foot parts 24*a*, 24*b*, 24*c* so that use of adhesive is avoided.

FIGS. 13 and 14 show a modification of the embodiment in the previous figures of a disposable vase according to the invention, and like parts are similarly referenced. In this modified embodiment the radial panels 5*a*, 5*b*, 5*c* are located opposite the side panels 11*a*, 11*b*, 11*c*, respectively, instead of opposite a fold line 12*e*, 12*c*, 12*a*, as shown for example in FIG. 10 of the first embodiment. This embodiment can moreover be folded, assembled, transported and modified in any of the ways described in the first embodiment.

The invention is described above and shown in the drawing on the assumption that the vase is hexagonal and the foot has three foot parts. Within the scope of the invention the vase can however have any other polygonal, circular or oval cross section and the foot another number of foot parts. Also, the edge of the vase can be designed with top panels of another configuration than the one shown or can be straight, that is without top panels, just as the edge need not be in a plane perpendicular to the axis of the vase but can instead be in another plane, for example a plane forming an angle with the axis and/or does not have a plane form.

The disposable vases are made of a durable, flexible, foldable disposable material that can resist water so that the vase will not leak when it e.g. is filled with water or wet Oasis. Similarly the glue used for gluing the flap 13 to the side panel 11*a* and the central panel 4 to the bottom panels, respectively, in the bottom 19 of the vase is chosen to be able to keep the foot and wall joined in a secure and watertight manner.

The vase can be made with decorations as desired. For example child-orientated illustrations, congratulations or advertisements or other indicia can be printed on the vase.

What is claimed is:

1. A vase made of a thin foldable material and having a wall, an upper opening and a lower bottom provided with a foot, with the vase being formed by a first planar material by folding along fold lines, with the first planar material including a central panel having essentially the same configuration as the bottom of the vase and defined by a first set of fold lines, a number of radial panels defined by a second set of fold lines and extending outwardly from the first fold lines, and a number of edge panels issuing from the second fold lines, wherein the fold lines and radial panels are located in a plane parallel to the upper opening of the vase and the central panel constitutes the lower bottom of the vase.

2. The vase of claim 1 wherein the foldable material is paper or cardboard.

3. The vase of claim 1, wherein the central panel of the first planar material is joined to the bottom of the vase with the first fold lines along the vase bottom, and the radial panels are folded up along the first fold lines and the edge panels around the vase and, in use, are unfolded in a plane with the central panel, whereas the edge panels are folded around the second fold lines.

4. The vase of claim 1, wherein the first planar material is designed in such a way that the edges of the edge panels issuing from the first fold lines abut against adjacent side panels of the vase in the position of use of the foot.

5. The vase of claim 1, which is formed by a second planar material that includes a number of side panels defined by a third set of fold lines, a number of bottom panels separated from the side panels by a fourth set of fold lines, and a number of top panels separated from the side panels by a fifth set of fold lines, and a flap extending along one of the outermost fold lines of the third set of fold lines.

6. The vase of claim 5, wherein the side panels each form a trapezium with the smallest side along a fold line in the fourth set of fold lines.

7. A vase made of a thin foldable material and having a wall, an upper opening and a lower bottom provided with a foot, with the vase being formed by first and second planar materials by folding along fold lines, with the first planar material designed with a central panel having essentially the same configuration as the bottom of the vase and defined by a first set of fold lines, a number of radial panels defined by a second set of fold lines and extending outwardly from the first fold lines, and a number of edge panels issuing from the second fold lines, and with the second planar material designed with a number of side panels defined by a third set of fold lines, a number of bottom panels separated from the side panels by a fourth set of fold lines, and a number of top panels separated from the side panels by a fifth set of fold lines, and a flap extending along one of the outermost fold lines of the third set of fold lines, wherein the first planar material has three radial panels and the second unfolding has six side panels and a flap.

8. A vase made of a thin foldable material and having a wall, an upper opening and a lower bottom provided with a foot, with the vase being formed by first and second planar materials by folding along fold lines, with the first planar material designed with a central panel having essentially the same configuration as the bottom of the vase and defined by a first set of fold lines, a number of radial panels defined by a second set of fold lines and extending outwardly from the first fold lines, and a number of edge panels issuing from the second fold lines, and with the second planar material designed with a number of side panels defined by a third set of fold lines, a number of bottom panels separated from the side panels by a fourth set of fold lines, and a number of top panels separated from the side panels by a fifth set of fold lines, and a flap extending along one of the outermost fold lines of the third set of fold lines, wherein the edge panels of the first planar material are designed with respective sixth and seventh sets of fold lines extending along the adjacent third fold lines when the radial panels are folded up along the first fold lines and the edge panels around the wall of the vase.

9. A vase made of a thin foldable material and having a wall, an upper opening and a lower bottom provided with a foot, with the vase being formed by first and second planar materials by folding along fold lines, with the first planar material designed with a central panel having essentially the same configuration as the bottom of the vase and defined by a first set of fold lines, a number of radial panels defined by a second set of fold lines and extending outwardly from the first fold lines, and a number of edge panels issuing from the second fold lines, and with the second planar material designed with a number of side panels defined by a third set of fold lines, a number of bottom panels separated from the side panels by a fourth set of fold lines, and a number of top panels separated from the side panels by a fifth set of fold lines, and a flap extending along one of the outermost fold lines of the third set of fold lines, wherein the edge panels of the first planar material are at an angular distance of 120°, and the first planar material is provided with a first slit each for receiving the point of a second edge panel when the radial panels are folded up along the first fold lines and the side panels around the wall of the vase.

10. The vase of claim 9, wherein the vase includes means for joining and securing two edge panels associated to a radial panel, wherein the means includes a staple, a clip, or an adhesive optionally protected by a pull-off film and applied on at least an area of the top surface of at least one of the two edge panels.

11. The vase of claim 9, wherein one of the two edge panels associated to a radial panel on the first planar material is designed with a second slit, and that the second edge panel is designed with a partially cut-out flap for insertion in the slit when the edge panels are folded up along the second fold lines.

12. The vase of claim 7 wherein the foldable material is paper or cardboard.

13. The vase of claim 8 wherein the foldable material is paper or cardboard.

14. The vase of claim 9 wherein the foldable material is paper or cardboard.

* * * * *